US007734202B2

(12) United States Patent
Lee et al.

(10) Patent No.: US 7,734,202 B2
(45) Date of Patent: Jun. 8, 2010

(54) APPARATUS FOR ADJUSTING FIXING PRESSURE AND IMAGE FORMING APPARATUS HAVING THE SAME

(75) Inventors: Choong-yong Lee, Seoul (KR); Woo-seog Kim, Seongnam-si (KR); Jung-yun Won, Suwon-si (KR); Jun-tae Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 241 days.

(21) Appl. No.: 11/869,182

(22) Filed: Oct. 9, 2007

(65) Prior Publication Data

US 2008/0181662 A1 Jul. 31, 2008

(30) Foreign Application Priority Data

Jan. 29, 2007 (KR) ..... 10-2007-0009138

(51) Int. Cl.
*G03G 15/00* (2006.01)
*G03G 21/00* (2006.01)
*G03G 15/20* (2006.01)

(52) U.S. Cl. ..... 399/45; 399/124; 399/328

(58) Field of Classification Search ..... 399/67, 399/320, 322, 328, 45, 124, 125
See application file for complete search history.

(56) References Cited

U.S. PATENT DOCUMENTS 6,687,468 B2 * 2/2004 Holubek et al. ..... 399/45
6,782,232 B2 * 8/2004 Hayami et al. ..... 399/328
7,039,332 B2 * 5/2006 Suzuki ..... 399/45
7,330,682 B2 * 2/2008 Shinshi ..... 399/124 X

* cited by examiner

*Primary Examiner*—Sandra L Brase
(74) *Attorney, Agent, or Firm*—Staas & Halsey LLP

(57) ABSTRACT

An apparatus for adjusting a fixing pressure of an image forming apparatus is provided. The apparatus for adjusting the fixing pressure includes a pair of pressing members to rotatably support an axis of a first roller from both ends and to rotate about a hinge shaft to cause the first roller to press against a second roller, a pair of hinge cams to move the hinge shaft of the pair of pressing members in either of two directions, a driving unit to rotate the pair of hinge cams, and a control unit to control the driving unit to adjust the position of the hinge shaft.

17 Claims, 6 Drawing Sheets

APPARATUS FOR ADJUSTING FIXING PRESSURE AND IMAGE FORMING APPARATUS HAVING THE SAME

CROSS-REFERENCE TO RELATED APPLICATIONS

This application claims the benefit of Korean Application No. 2007-9138, filed Jan. 29, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an apparatus for adjusting pressure of a fixing unit, and an image forming apparatus having the same.

2. Description of the Related Art

An image forming apparatus generally operates to form a toner image onto a photosensitive medium, and transfer the toner image onto a printing medium. The image forming apparatus includes a fixing unit to fix the toner image onto the printing medium by heat and pressure.

The fixing (i.e., fusing) unit generally includes a heating roller to generate a high temperature heat, and a pressing roller to press against the heating roller with a predetermined pressing force. An elastic member is employed to support the pressing roller, such that the pressing roller presses the heating roller with a predetermined pressure. Accordingly, a toner image is fixed onto a printing medium when the printing medium passes between the heating roller and the pressing roller.

Because the fixing unit is usually set to have a specific pressing force, that is, set for standard printing paper, problems occur when a printing medium other than standard printing paper is passed through the fixing unit. For example, if an envelope, which is thicker than standard printing paper, is passed through the heating and pressing rollers, the envelope will usually have a crease.

In order to solve the above problem, an image forming apparatus is conventionally provided with a separate manually-operable lever, to adjust the pressure exerted on the pressing roller by the elastic member in accordance with the thickness of the printing medium. That is, in order to print on an envelope, a user operates the manually-operable lever to adjust the pressing force of the pressing roller and to prevent generation of a crease on the envelope. However, the user is inconvenienced, because he has to operate the manually-operable lever whenever it is necessary to print on the envelope.

SUMMARY OF THE INVENTION

Aspects of the present invention provide an apparatus for adjusting fixing pressure in response to a signal, and an image forming apparatus having the same. One example aspect of the present invention provides an apparatus for adjusting fixing pressure, comprising: i) a pair of pressing members to rotatably support the axis of a first roller from both ends and to rotate about a hinge shaft to cause the first roller to press against a second roller; ii) a pair of hinge cams to move the hinge shaft of the pair of pressing members in either of two directions iii) a driving unit to rotate the pair of hinge cams; and iv) a control unit to control the driving unit to adjust the position of the hinge shaft.

The driving unit may comprise a cam shaft on which the pair of hinge cams is disposed, and the driving unit rotates the cam shaft with a rotational force of a fixing motor that drives the first roller or the second roller. The driving unit also may comprise a cam gear formed on one end of the cam shaft, a medium gear meshed with the cam gear, and a swing gear assembly to be selectively meshed with the medium gear according to the direction in which the fixing motor is rotated. The driving unit may also comprise a cam shaft on which the pair of hinge cams is disposed, and a fixing pressure adjusting motor to rotate the cam shaft. In addition, the driving unit may comprise a cam shaft on which the pair of hinge cams is disposed, and a driving force blocker unit formed on one end of the cam shaft, to block a driving force from being transmitted to the cam shaft, according to the position of the hinge cams. Finally, the driving force blocker unit may comprise a stop dog formed on one end of the cam shaft, and a stop sensor configured to be operated according to the stop dog.

A position sensor may be further provided to detect the position of the hinge cams. The position sensor may be configured to detect a position dog formed on one end of the cam shaft on which the hinge cams are disposed. The position sensor may also be configured to detect the position of the hinge shaft.

Another example aspect of the present invention provides an image forming apparatus comprising: i) a pressing roller and a heating roller configured to rotate while the rollers face each other and to fix a toner image onto a printing medium, and; ii) a fixing pressure adjusting apparatus configured to adjust the pressure with which the pressing roller presses against the heating roller. The fixing pressure adjusting apparatus may further comprise: i) a pair of pressing members to rotatably support an axis of the pressing roller from both ends and to rotate about a hinge shaft to cause the pressing roller to press against the heating roller; ii) a pair of hinge cams to move the hinge shaft of the pair of pressing members in either of two directions; iii) a driving unit to rotate the pair of hinge cams; and iv) a control unit to control the driving unit to adjust the position of the hinge shaft.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
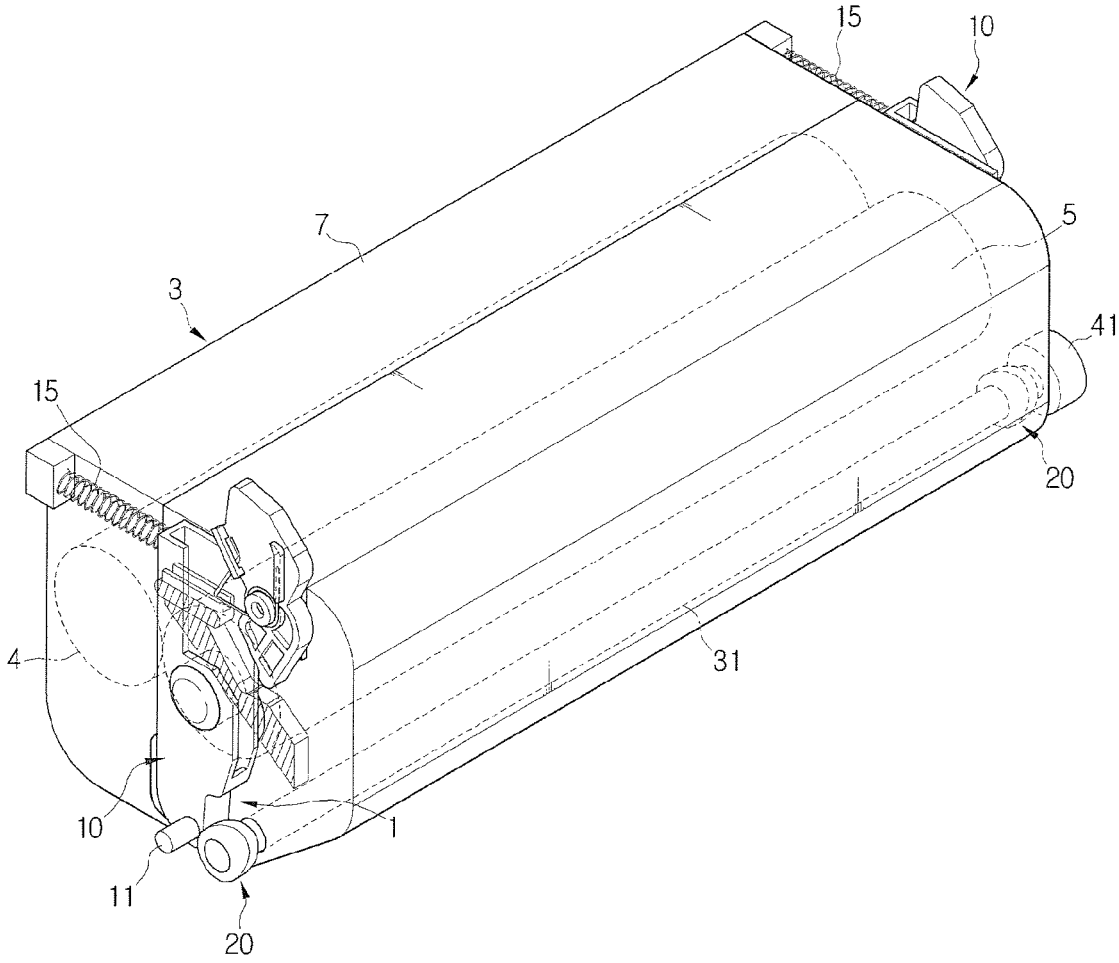
FIG. 1 is a perspective view of a fixing pressure adjusting apparatus according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
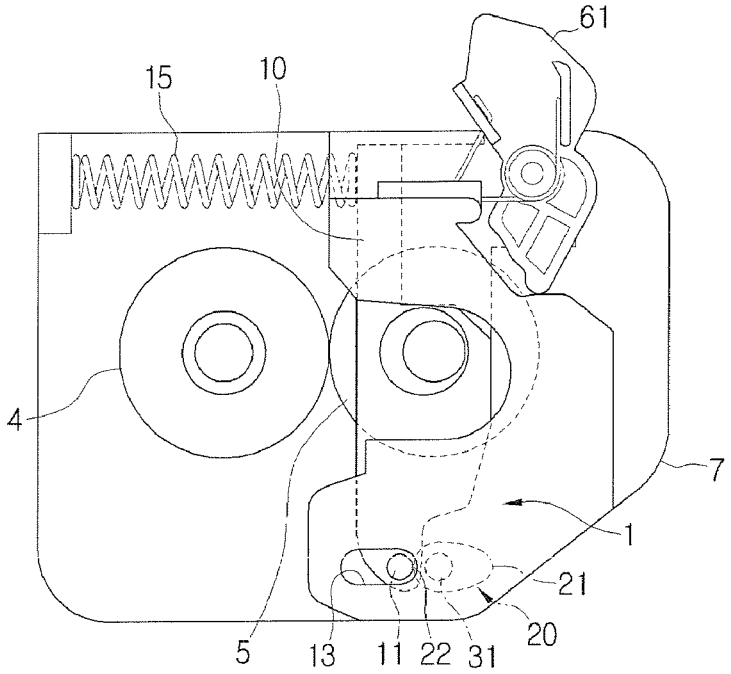
FIG. 2 is a side view of the fixing pressure adjusting apparatus of FIG. 1 in a standard paper printing mode.
Figure 3:
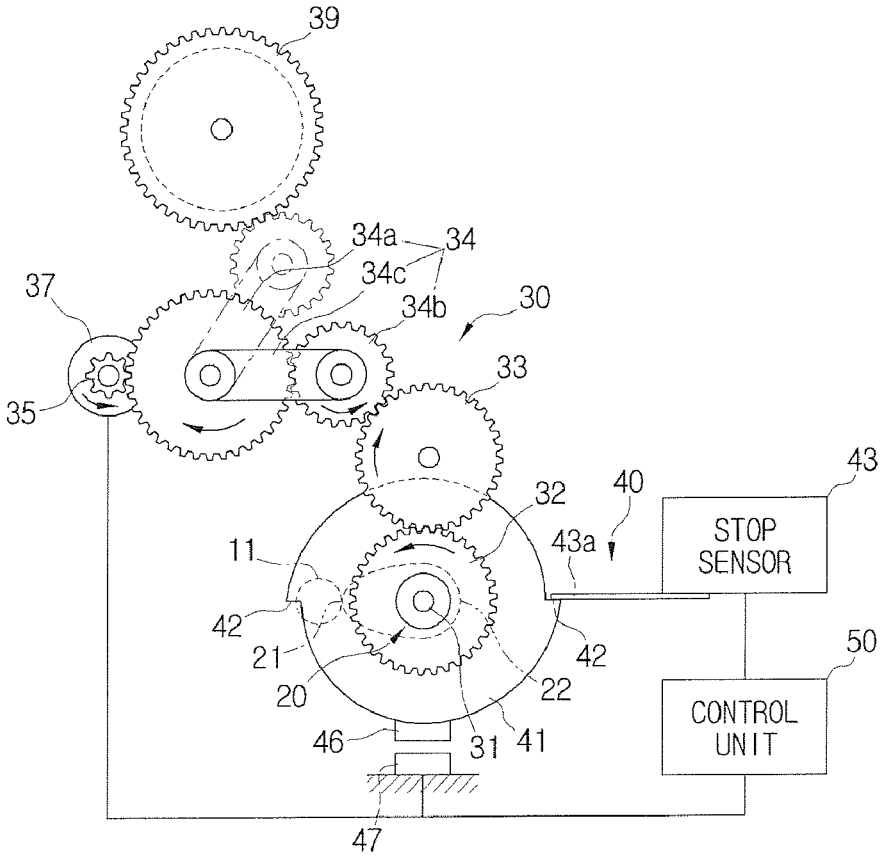
FIG. 3 is a view illustrating an example of a driving unit of the fixing pressure adjusting apparatus of FIG. 1.

FIG. 1 is a perspective view of a fixing pressure adjusting apparatus mounted to a fixing unit according to an exemplary embodiment of the present invention, FIG. 2 is a side view of FIG. 1, and FIG. 3 is a view illustrating an example of a driving unit of the fixing pressure adjusting apparatus of FIG. 1. In FIGS. 1 to 3, a fixing pressure adjusting apparatus 1 according to an exemplary embodiment of the present invention includes a pair of pressing members 10, a pair of hinge cams 20, a driving unit 30, and a control unit 50.

The pair of pressing members 10 is configured such that a first roller 5 presses a second roller 4. That is, the pressing members 10 rotatably support the axis of the first roller 5 on opposite sides, and are rotatable about a hinge shaft 11 formed in a lower portion. The hinge shaft 11 of the pressing members 10 is inserted in a hinge hole 13. In an exemplary implementation, the hinge hole 13 is formed in a housing 7 of a fixing unit 3. Elastic members 15 are disposed at upper parts of the pressing members 10, to pull the pressing members 10 toward the second roller 4. As a result, the first roller 5, being supported by the pair of pressing members 10, is urged toward the second roller 4 with a predetermined pressure.

In the following exemplary embodiment of the present invention, the first roller 5 is used as a pressing roller of the fixing unit 3, and the second roller 4 is used as a heating roller. Therefore, the first and the second rollers 5, 4 will be explained as the pressing roller and the heating roller, respectively.

The pair of hinge cams 20 is formed, to move the hinge shaft 11 of the pair of pressing members 10 in either of two directions. The pair of hinge cams 20 is disposed on a cam shaft 31 and rotated integrally with the cam shaft 31. A curve profile is formed on the hinge cam 20 such that the cam shaft 31 keeps contact with the hinge shaft 11 during rotation, and the hinge shaft 11 moves in a left direction when the top 21 of the hinge cam 20 contacts the hinge shaft 11, while the hinge shaft 11 returns to the initial position when the bottom 22 of the hinge cam 20 contacts the hinge shaft 11.

Figure 4:
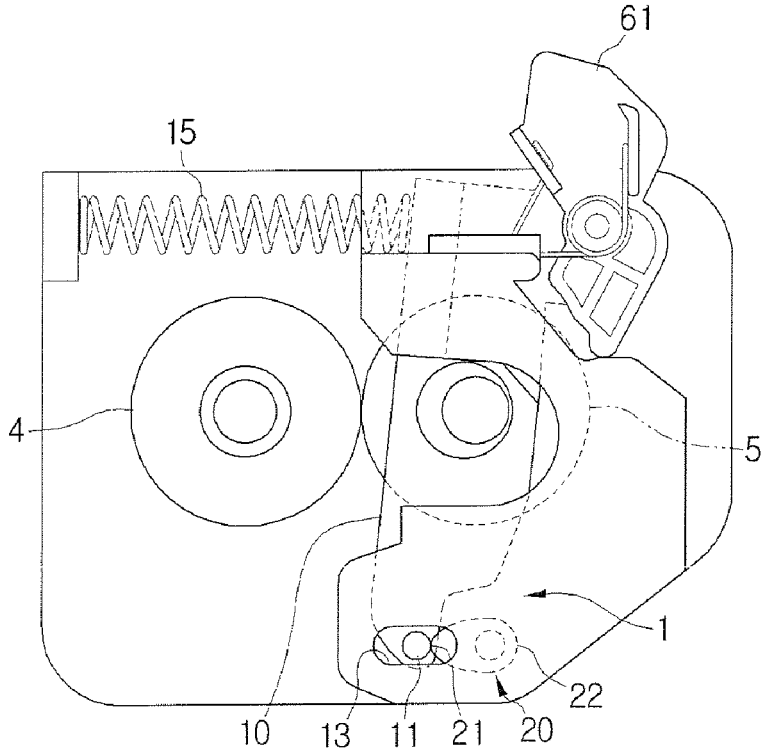
FIG. 4 is a side view illustrating the fixing pressure adjusting apparatus of FIG. 1 in an envelope printing mode.

FIG. 2 illustrates the hinge shaft 11 in the initial position. The hinge shaft 11 is at the right side of the hinge hole 13, and contacts with the bottom 22 of the hinge cam 20. FIG. 4 illustrates the hinge shaft 11 moved toward the left side. The hinge shaft 11 is positioned toward the left side of the hinge hole 13, and contacts with the top 21 of the hinge cam 20. When the hinge shaft 11 moves leftward, the upper parts of the pressing members 10 are moved rightward. Accordingly, the pressing roller 5, being supported by the pressing members 10, is moved rightward, and as a result, the force of the pressing roller 5 pressing the heating roller 4 is decreased. To simplify the discussion, in the following description of the exemplary embodiments of the present invention, an "envelope printing position" is where the hinge shaft 11 contacts the top 21 of the hinge cam 20 and thus the hinge shaft 11 is moved toward the left, and a "standard printing position" is where the hinge shaft 11 contacts the bottom 22 of the hinge cam 20 and thus the hinge shaft 11 is in the initial position.

The driving unit 30 drives the pair of hinge cams 20 to rotate according to a signal from the control unit 50. Referring to FIGS. 1 and 3, the driving unit 30 includes the cam shaft 31, a cam gear 32, a medium gear 33, a swing gear assembly 34 and a fixing motor 37.

The pair of hinge cams 20 is formed on the cam shaft 31, and the cam gear 32 is formed on one end of the cam shaft 31. The medium gear 33 is always meshed with the cam gear 32, and selectively meshed with the swing gear assembly 34 according to the direction of the rotation of the fixing motor 37.

The swing gear assembly 34 selectively transmits the rotational force of the fixing motor 37 either to the fixing gear 39 rotating the pressing roller 5 and the heating roller 4 of the fixing unit 3, or to the medium gear 33, according to the rotational direction of the fixing motor 37. The swing gear assembly 34 includes a stationary gear 34*a* that meshes with a pinion 35 of the fixing motor 37 to receive rotational force, a satellite gear 34*b* to revolve according to the stationary gear 34*a*, and a swing arm 34*c* to connect the stationary gear 34*a* with the satellite gear 34*b*.

Referring to FIG. 3, when the fixing motor 37 rotates counterclockwise, the rotational force of the fixing motor 37 is transmitted to the medium gear 33 by the swing gear assembly 34, and as a result, the cam gear 32 rotates counterclockwise. When the cam gear 32 rotates, the pair of hinge cams 20 disposed on the cam shaft 31 also rotates.

When the fixing motor 37 rotates clockwise, the stationary gear 34*a* of the swing gear assembly 34 rotates counterclockwise. Accordingly, the satellite gear 34*b* revolves counterclockwise according to the stationary gear 34*a*, and meshes with the fixing gear 39 of the fixing unit 3 as indicated by the phantom line in FIG. 3. As a result, the pressing roller 5 and the heating roller 4 rotate, conveying a printing medium entered in between the pressing roller 5 and the heating roller 4. This exemplary embodiment provides one example of driving the driving unit 30 using the fixing motor 37 which drives the heating roller 4 and the pressing roller 5. However, a dedicated motor to rotate the cam shaft 31, that is, a fixing pressure adjusting motor (not shown) may be employed as the driving unit 30 to rotate the hinge cams 20 according to an alternative example.

The driving unit 30 includes a driving force blocker 40 to block a driving force from transmitting to the cam shaft 31 according to the position of the hinge cams 20. The driving force blocker 40 includes a stop dog 41 formed at one end of the cam shaft 31, and a stop sensor 43 operating in accordance with the stop dog 41. The stop dog 41 may be shaped in a cylindrical configuration, and two protrusions 42 are formed on the outer circumference of the stop dog 41 to operate the stop sensor 43. The two protrusions 42 are distanced apart from each other by a 180° interval. When the protrusions 42 operate the stop sensor 43, the control unit 50 reads that the stop sensor 43 is on. In an exemplary implementation, a limit switch is used as the stop sensor 43, which is operated in conjunction with the protrusions 42. Accordingly, when the protrusions 42 are locked in the leading end of lever 43*a* of the limit switch 43, the control unit 50 reads this, and thus stops the fixing motor 37. Any suitable sensor may be used as the stop sensor 43, provided that the sensor is able to detect the protrusions 42.

The driving unit 30 may additionally include a position sensor 47 to detect the location of the hinge cams 20. When the position sensor 47 detects the location of the hinge cams 20, the control unit 50 can determine whether the hinge shaft 11 is in the initial position or moved to the left side. Accordingly, the control unit 50 can determine, based on the position sensor 47, whether the hinge shaft 11 is in the envelope printing position, or the standard printing position. The position sensor 47 may be installed to detect the location of the hinge cams 20. Alternatively, the position sensor 47 may be installed on a side of the hinge shaft 11 to directly detect the location of the hinge shaft 11.

Figure 5:
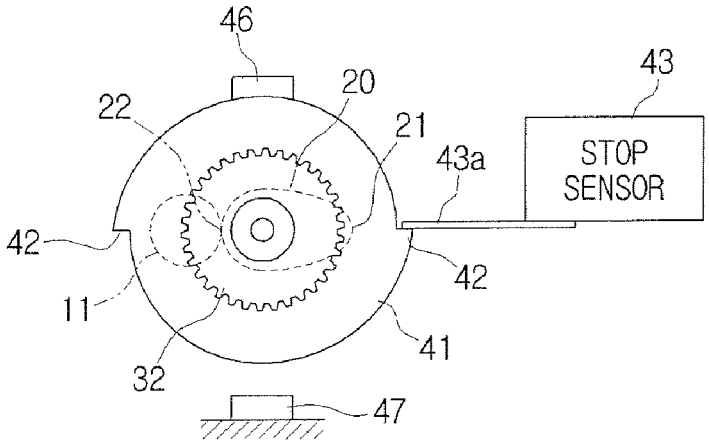
FIG. 5 is a view illustrating the relationship between a stop dog and a positioning dog in a standard paper printing mode.

Referring to FIGS. 3 and 5, in another exemplary implementation, the position sensor 47 is installed such that it detects the location of the hinge cams 20. That is, a position dog 46 is disposed at a position on the outer circumference of the stop dog 41 so as not to interfere with the stop sensor 43 of the stop dog 41, and a photo sensor, employed as the position sensor 47, detects the position dog 46.

The control unit 50 controls the driving unit 30 such that the hinge shaft 11 of the pressing member 10 is in the envelope printing position or the standard printing position. The control unit 50 is electrically connected with the fixing motor 37, the stop sensor 43, and the position sensor 47. The control unit 50 may be provided separately, but it is preferable that the control unit 50 be formed as a part of a main control unit (not described) that controls the image forming apparatus in performance of its printing operation.

When a user selects an envelope printing mode through an operating instruction panel (not shown), the control unit 50 controls the fixing motor 37 such that the hinge shaft 11 of the pressing member 10 is moved to one side, and the pressure is lessened between the pressing roller 5 and the heating roller 4. However, when the user selects a standard printing mode, the control unit 50 controls the fixing motor 37 to return the hinge shaft 11 of the pressing member 10 to the initial position, such that the pressure between the pressing roller 5 and the heating roller 4 is increased. Accordingly, a printing mode selector such as a printing mode button, should be provided on the operating instruction panel, such that a user is able to select between the envelope printing mode and the standard printing mode.

The control unit 50 determines the position of the hinge shaft 11 according to whether or not the stop sensor 43 and the position sensor 47 operate. Referring again to FIG. 3, if the protrusions 42 of the stop dog 41 activate the stop sensor 43 and the position dog 46 is positioned in the detecting area of the position sensor 47, that is, if both the stop sensor 43 and the position sensor 47 are in the on state, the control unit 50 determines that the hinge shaft 11 is in the envelope printing position.

Referring to FIG. 5, if the protrusions 42 of the stop dog 41 activate the stop sensor 43, but if the position dog 46 is not positioned in the detecting area of the position sensor 47, that is, if the stop sensor 43 is in the on state, but if the position sensor 47 is in the off state, the control unit 50 determines that the hinge shaft 11 is in the standard printing position.

The operation of the fixing pressure adjusting apparatus 1 according to the exemplary embodiments of the present invention will be explained below, with reference to FIGS. 1 through 5. When a user selects the envelope printing mode, the control unit 50 determines whether the hinge shaft 11 of the pressing member 10 is in the envelope printing position. If neither the stop sensor 43 nor the position sensor 47 are in the on state, that is, if the stop sensor 43 is in the on state, but the position sensor 47 is in the off state, the control unit 50 determines that the hinge shaft 11 of the pressing member 10 is in the standard printing position, and moves the hinge shaft 11 to the envelope printing position.

The process in which the control unit 50 moves the hinge shaft 11 of the pressing member 10 to the envelope printing position, will now be explained. The control unit 50 causes the fixing motor 37 to rotate counterclockwise. When the fixing motor 37 rotates counterclockwise, the stationary gear 34*a* of the swing gear assembly 34 rotates clockwise, and the satellite gear 34*b* revolves clockwise to be meshed with the medium gear 33. Because the satellite gear 34*b* rotates counterclockwise, the medium gear 33 rotates clockwise. When the medium gear 33 rotates clockwise, the cam gear 32 rotates counterclockwise, and accordingly, the cam shaft 31 rotates counterclockwise. When the cam shaft 31 rotates, the hinge shaft 11 moves leftward by the hinge cams 20. At the same time, the control unit 50 determines whether the stop sensor 43 is turned to the on state. If the stop sensor 43 is turned to the on state, the control unit 50 causes the fixing motor 37 to stop. The control unit 50 determines whether the position sensor 47 is turned to the on state. If both the stop sensor 43 and the position sensor 47 are in the on state, as shown in FIG. 3, the tops 21 of the hinge cams 20 are in contact with the hinge shaft 11. That is, the hinge shaft 11 is in the envelope printing position.

While the hinge shaft 11 of the pressing member 10 is in the envelope printing position, if a user selects the standard printing mode, the control unit 50 causes the fixing motor 37 to rotate counterclockwise.

When the fixing motor 37 rotates clockwise, the hinge cams 20 rotate clockwise. According to the rotation of the hinge cams 20, the parts of the hinge cams 20 contacting the hinge shaft 11 move from the tops 21 to the bottoms 22. The control unit 50 monitors whether the stop sensor 43 returns to the on state, while the fixing motor 37 is rotating. If the stop sensor 43 is turned to the on state, the control unit 50 causes the fixing motor 37 to stop, and determines whether the position sensor 47 is in the off state. If the stop sensor 43 is in the on state, and the position sensor 47 is in the off state as shown in FIG. 5, the control unit 50 determines it to be the standard printing position.

With the fixing pressure adjusting apparatus 1 according to the exemplary embodiments of the present invention, a user is only required to select the envelope printing mode, and then the fixing pressure of the fixing unit 3 is adjusted to accommodate envelope printing in response to a signal rather than manually by a user. Of course, other types of printing media having a thickness similar to an envelope, may be printed in the envelope printing mode.

Figure 6:
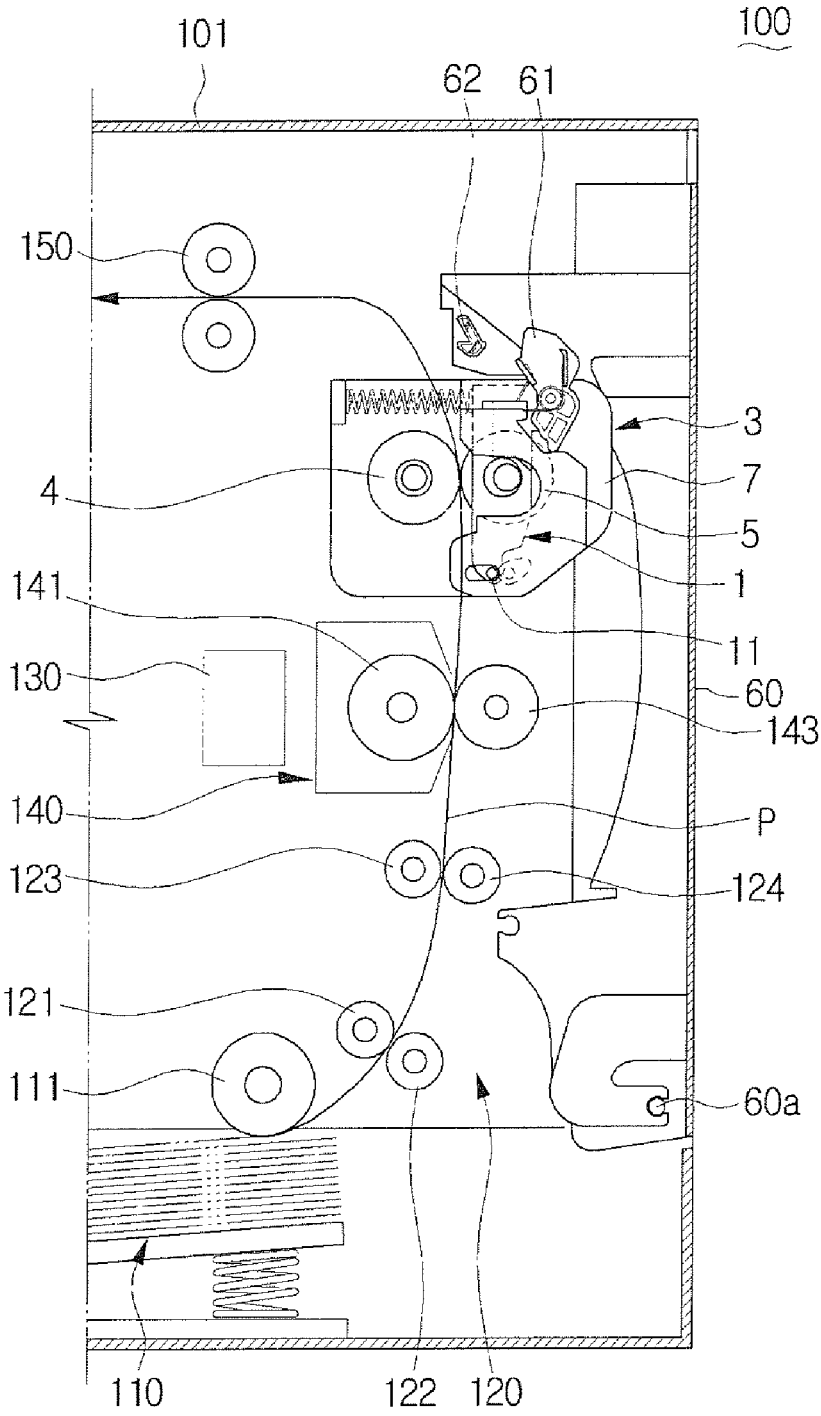
FIG. 6 is a sectional view illustrating an image forming apparatus having a fixing pressure adjusting apparatus according to an exemplary embodiment of the present invention.

FIG. 6 is a sectional view illustrating an image forming apparatus 100 having a fixing pressure adjusting apparatus according to an exemplary embodiment of the present invention. In FIG. 6, the image forming apparatus 100 having the fixing pressure adjusting apparatus includes a paper feeding unit 110, a paper conveying unit 120, a light exposure unit 130, an image forming unit 140, a transfer roller 143, the fixing unit 3, the fixing pressure adjusting apparatus 1, and a main body housing 101.

The paper feeding unit 110 stores a plurality of printing media, and includes a pickup roller 111 to pick up the printing media P sheet by sheet.

The paper conveying unit 120 feeds a sheet of printing medium P picked up from the paper feeding unit 110 to pass between the image forming unit 140 and the transfer roller 143. The paper conveying unit 120 includes a feed roller 121 to feed the printing medium P, a feed backup roller 122 driven by the feed roller 121, a register roller 123 regulating the leading end of the printing medium P, and a register backup roller 124 driven by the register roller 123.

The light exposure unit 130 emits a laser beam calibrated according to the print data onto a photosensitive medium 141. The image forming unit 140 includes the photosensitive medium 141 on which an electrostatic latent image is formed, and a developer to develop the electrostatic latent image of the photosensitive medium 141 with toner.

The transfer roller 143 rotates, facing the photosensitive medium 141, and transfers the visualized image on the photosensitive medium 141 onto the printing medium P fed from the paper feeding unit 110.

The fixing unit 3 includes the pressing roller 5, the heating roller 4, and the housing 7 to support the pressing roller 5 and the heating roller 4. The fixing unit 3 operates to fix a toner image onto the printing medium P passing between the pressing roller 5 and the heating roller 4, by applying heat and pressure.

The fixing pressure adjusting apparatus 1 includes the pair of pressing members 10 hinged to the housing 7 of the fixing unit 3 to support the pressing roller 5 to press against the heating roller 4, the pair of hinge cams 20 to move the hinge shaft 11 of the pair of pressing members 10, and the driving unit 30 to rotate the pair of hinge cams 20. A pair of first levers 61 is hinged to the upper end of the pressing members 10 to move in association with the opening and closing of a side cover 60 and to rotate the pressing members 10. When the first levers 61 rotate, the pressing members 10 rotate clockwise about the hinge shaft 11, such that the pressing roller 5 is spaced apart from the heating roller 4.

The main body housing 101 includes the above-explained units and guiding members to form a passage through which the printing medium P is conveyed. The side cover 60 is fixed to a side of the main body housing 101 by a hinge 60a to open the upper part of the fixing unit 3 when it is necessary to remove any jammed paper. The side cover 60 includes a pair of second levers 62 to operate the first levers 61 of the pressing members 10. Accordingly, by opening the side cover 60, the second levers 62 operate the first levers 61, and as a result, the pressing roller 5 is spaced apart from the heating roller 4. In this state, the user removes a jammed paper.

Figure 7:
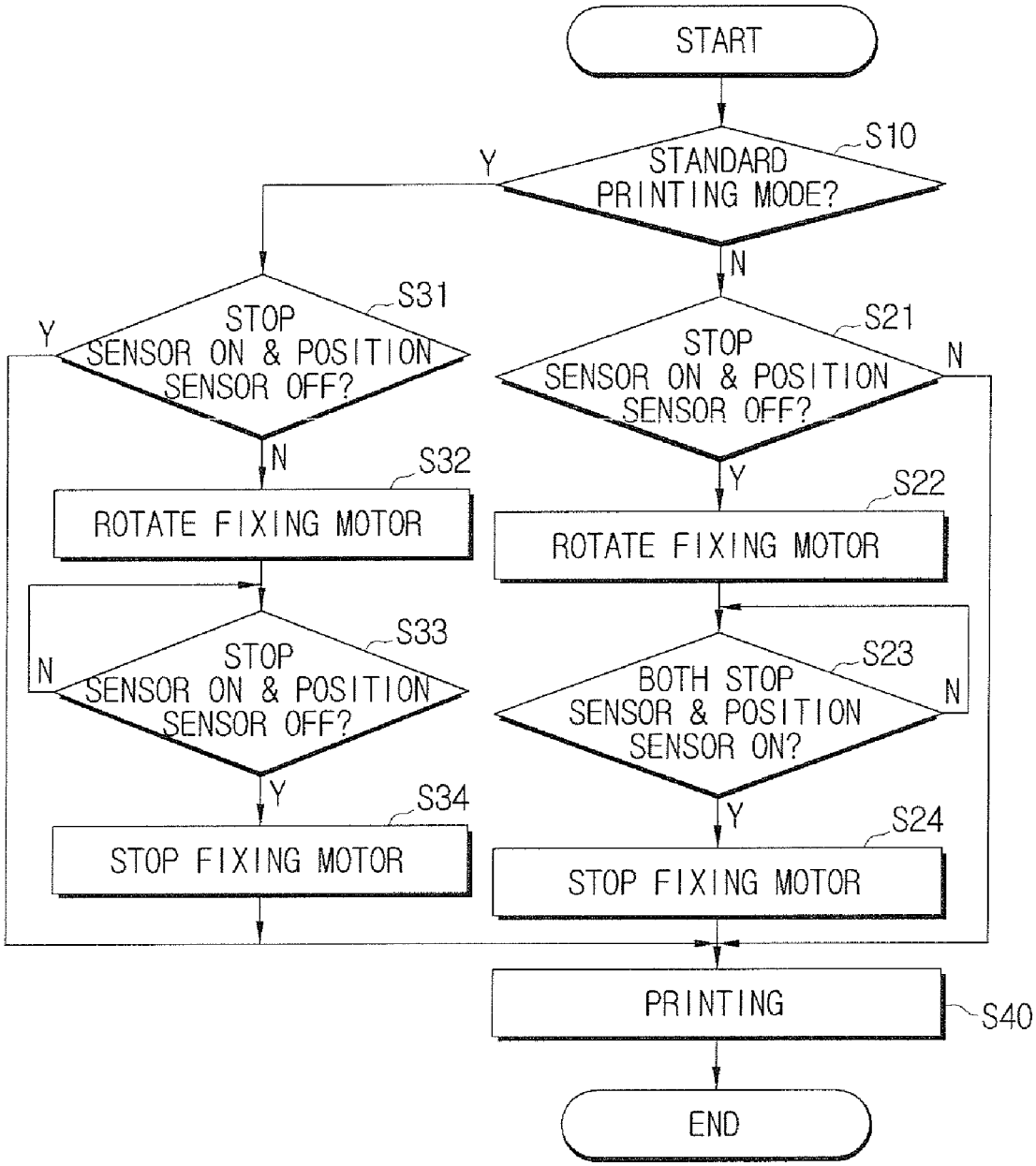
FIG. 7 is a flowchart illustrating an example of a control method of an image forming apparatus having a fixing pressure adjusting apparatus according to an exemplary embodiment of the present invention.

The method of the image forming apparatus 100 printing on an envelope in the user-selected envelope printing mode, will now be explained, with reference to FIG. 7. Upon receipt of a print command, the main control unit (not shown) determines whether it is the standard printing mode (S10). If at operation S10 it is determined that the printing mode is not the standard printing mode (the arrow with N for no), it must be that the envelope printing mode has been selected (the arrow with Y for yes). In the following exemplary embodiment, the control unit 50 of the fixing pressure adjusting apparatus 1 operates as the main control unit.

In the envelope printing mode, the control unit 50 determines whether the stop sensor 43 is turned to the on state, and the position sensor 47 is in the off state (S21). If the stop sensor is turned to the on state, and the position sensor is in the off state, the control unit 50 rotates the fixing motor counterclockwise (S22). The control unit 50 then monitors to see whether both the stop sensor 43 and the position sensor 55 are in the on state (S23). If both the stop sensor 43 and the position sensor 47 are on, the control unit 50 stops the fixing motor 37 (S24). By the movement of the pair of hinge cams 20, the hinge shaft 11 of the pressing members 10 moves leftward, that is, is positioned in the envelope printing position. The process of moving the hinge shaft 11 by the movement of the hinge cams 20 was explained above, and therefore, will be omitted for the sake of brevity.

When the hinge shaft 11 of the pressing member 10 is in the envelope printing position, the control unit 50 controls the light exposure unit 130 to emit a laser beam onto the photosensitive medium 141 according to the print data received. Accordingly, an electrostatic latent image corresponding to the print data is formed on the surface of the photosensitive medium 141. When the photosensitive medium 141 rotates, the electrostatic latent image is developed into a visible image by the toner fed from the developing means formed in proximity to the photosensitive medium 141. The pickup roller 111 of the paper feeding unit 110 picks up a sheet of an envelope P from the stack of envelopes, and feeds the picked up envelope P to the feed roller 121. The leading end of the envelope P is aligned by the feed roller 121 and the register roller 123, and the envelope P is then fed in between the image forming unit 140 and the transfer roller 143. When the envelope P enters into the transfer roller 143, the visible image on the photosensitive medium 141 is transferred onto the envelope P by the transfer roller 143. The envelope P, bearing the transferred image thereon, is entered between the pressing roller 5 and the heating roller 4 of the fixing unit 3. Accordingly, the image is fixed onto the enveloped P at the fixing unit 3, by the pressure of the pressing roller 5 and the heat of the heating roller 4. Because the pressure of the pressing roller 5 is adjusted in advance to suit printing on the envelope P, a crease on the envelope P is prevented. After this fixation, the envelope P is discharged out of the main body housing 101 by a paper discharge roller 150.

In order to print on standard paper, a user may select the standard printing mode on the operating instruction panel, and may press the printing start button. Upon receipt of a printing command, the main control unit determines whether it is the standard printing mode (S10). Upon determination that it is the standard printing mode, the control unit 50 determines whether the stop sensor 43 is turned to the on state, and the position sensor 47 is in the off state (S31). If both the stop sensor 43 and the position sensor 47 are in the on state, the control unit 50 causes the fixing motor 37 to rotate counterclockwise (S32). The control unit 50 then monitors the stop sensor 43 and the position sensor 47 (S33). If the stop sensor 43 is turned to the on state, and the position sensor 47 is turned to the off state, the control unit 50 stops the fixing motor 37 (S34). According to the movement of the pair of hinge cams 20, the hinge shaft 11 of the pressing members 10 is returned to the initial position, that is, to the standard printing position. The process of moving the hinge shaft 11 by the movement of the hinge cams 20 has already been explained above, and therefore, it will not be explained in detail below for the sake of brevity. When the hinge shaft 11 of the pressing member 10 is in the standard printing position, the control unit 50 performs the printing process as explained above (S40).

Figure 8:
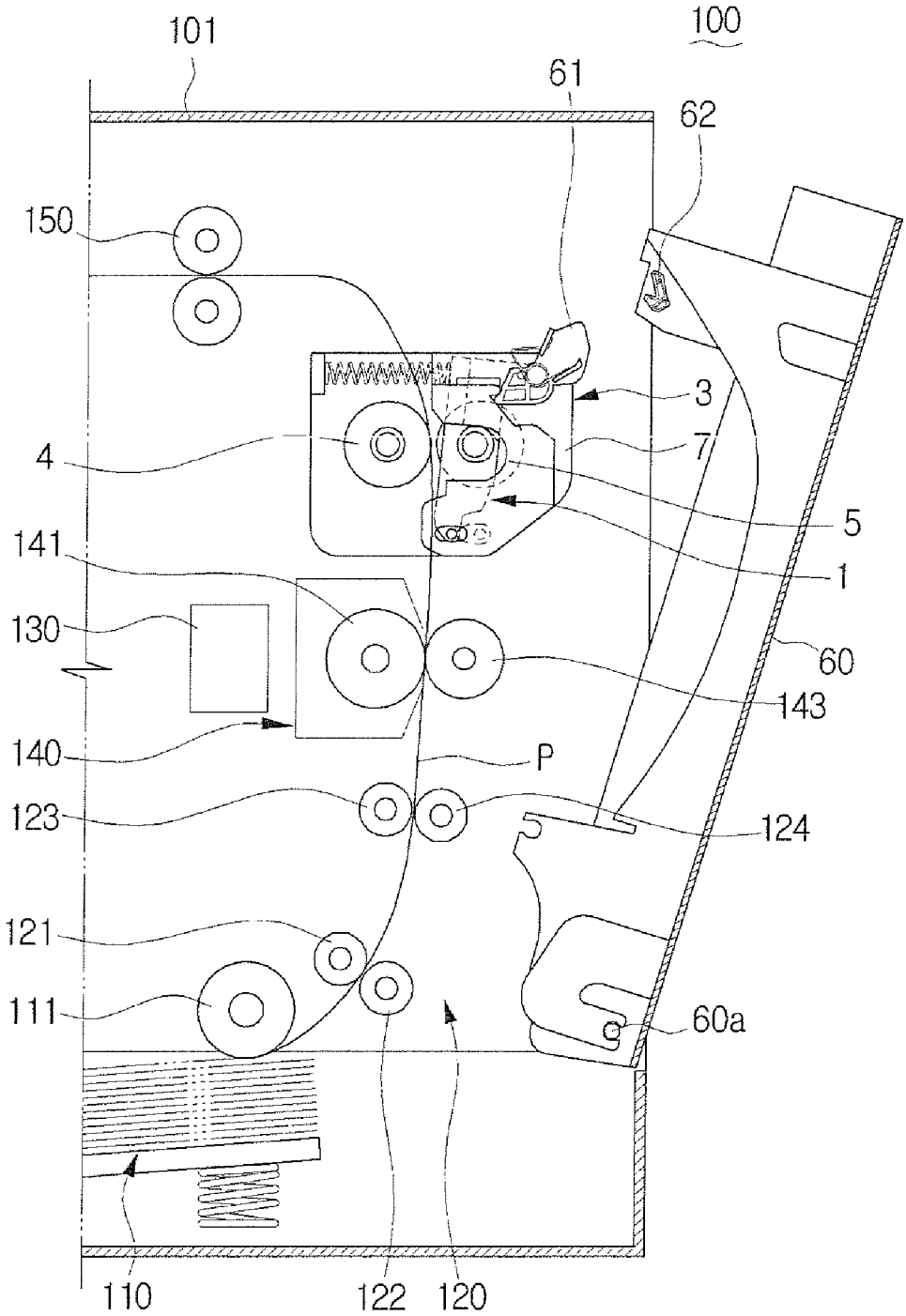
FIG. 8 is a sectional view illustrating the image forming apparatus of FIG. 6, with its side cover open, to remove a paper jam from a fixing unit.

During the printing process, a printing medium P, either standard paper or envelope, may not be conveyed normally, and a paper jam may occur. In the case of jammed paper in the fixing unit 3, the user opens the side cover 60, according to which the heating roller 4 is spaced apart from the pressing roller 5 by the first and second levers 61, 62 (FIG. 8). Accordingly, the user may remove the jammed paper with ease. After removal of the jammed paper, the user closes the side cover 60, and accordingly, the heating roller 4 and the pressing roller 5 are returned to contact each other as shown in FIG. 6. Thereafter, the image forming apparatus 100 may resume printing.

Controlling the fixing unit 3 of the image forming apparatus 100 having the fixing pressure adjusting apparatus 1 according to the exemplary embodiments of the present invention may include the three stages, that is: i) the first stage of printing on standard paper, in which the pressing roller 5 is pressed against the heating roller 4 with the maximum fixing pressure, ii) the second stage of printing on a relatively thicker printing medium such as an envelope, in which the pressing roller 5 is pressed under a smaller pressure than in the first stage, and iii) the third stage of spacing the pressing roller 5 and the heating roller 4 apart from each other for the removal of jammed paper.

With the image forming apparatus having the fixing pressure adjusting apparatus 1 according to the exemplary embodiments of the present invention, when a user selects either the standard printing mode or the envelope printing mode, the position of the hinge shaft of the pressing members is adjusted automatically between the two settings, to appropriately adjust the pressure of the fixing unit to suit for the type of the printing medium P. Accordingly, no crease is generated, even when a relatively thicker printing medium P such as an envelope is printed.

With the fixing pressure adjusting apparatus 1 and the image forming apparatus having the same according to the exemplary embodiments of the present invention, the fixing pressure of the fixing unit is adjusted appropriately to suit for the type of the printing medium, and as a result, no crease is generated even when a relatively thicker printing medium P is printed.

Furthermore, because a user is able to select a printing mode on the operating instruction panel, and the fixing pressure is adjusted automatically according to the printing mode selected by the user, it is simple and easy to operate.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for adjusting a fixing pressure, comprising:

a pair of pressing members to rotatably support an axis of a first roller from both ends, and to rotate about a hinge shaft to cause the first roller to press against a second roller;

a pair of hinge cams to move the hinge shaft of the pair of pressing members in either of two directions;

a driving unit to rotate the pair of hinge cams; and a control unit to control the driving unit to adjust the position of the hinge shaft, wherein the driving unit comprises a cam shaft on which the pair of hinge cams are disposed, and the driving unit rotates the cam shaft with the rotational force of a fixing motor that drives the first roller or the second roller.

2. The apparatus of claim 1, wherein the driving unit comprises:

a cam gear formed on one end of the cam shaft;

a medium gear meshed with the cam gear; and a swing gear assembly to be selectively meshed with the medium gear according to the direction in which the fixing motor is rotated.

3. The apparatus of claim 1, wherein the driving unit comprises a cam shaft on which the pair of hinge cams is disposed; and a fixing pressure adjusting motor to rotate the cam shaft.

4. The apparatus of claim 1, wherein the driving unit comprises a cam shaft on which the pair of hinge cams is disposed; and a driving force blocker unit formed on one end of the cam shaft to block a driving force from being transmitted to the cam shaft according to the position of the hinge cams.

5. The apparatus of claim 4, wherein the driving force blocker unit comprises:

a stop dog formed on one end of the cam shaft; and a stop sensor configured to be operated according to the stop dog.

6. The apparatus of claim 1, further comprising a position sensor to detect the position of the hinge cams.

7. The apparatus of claim 6, wherein the position sensor is configured to detect a position dog formed on one end of a cam shaft on which the hinge cams are disposed.

8. The apparatus of claim 6, wherein the position sensor is configured to detect the position of the hinge shaft.

9. An image forming apparatus, comprising:

a pressing roller and a heating roller configured to rotate, while facing each other, and to fix a toner image onto a printing medium; and a fixing pressure adjusting apparatus configured to adjust a pressure with which the pressing roller presses against the heating roller, the fixing pressure adjusting apparatus comprising:

a pair of pressing members to rotatably support an axis of the pressing roller from both ends, and to rotate about a hinge shaft to cause the pressing roller to press against the heating roller, a pair of hinge cams to move the hinge shaft of the pair of pressing members in either of two directions, a driving unit to rotate the pair of hinge cams, and a control unit to control the driving unit to adjust the position of the hinge shaft, wherein the driving unit comprises a cam shaft on which the pair of hinge cams are disposed, and the driving unit rotates the cam shaft with a rotational force of a fixing motor which drives the pressing roller or the heating roller.

10. The image forming apparatus of claim 9, wherein the driving unit comprises:

a cam gear formed on one end of the cam shaft;

a medium gear meshed with the cam gear; and a swing gear assembly to be selectively meshed with the medium gear according to the direction in which the fixing motor is rotated.

11. The image forming apparatus of claim 9, wherein the driving unit comprises a cam shaft on which the pair of hinge cams is disposed; and a driving force blocker unit formed on one end of the cam shaft to block a driving force from being transmitted to the cam shaft according to the position of the hinge cams.

12. The image forming apparatus of claim 11, wherein the driving force blocker unit comprises:

a stop dog formed on one end of the cam shaft; and a stop sensor configured to be operated according to the stop dog.

13. The image forming apparatus of claim 9, further comprising a position sensor to detect the position of the hinge cams.

14. An image forming apparatus comprising:

a thickness selector receiving an input as to a thickness of a print medium;

a pressing roller and a heating roller configured to rotate, while facing each other, and to fix a toner image onto the print medium;

a plurality of elastic members disposed at upper ends of the pressing roller to pull the pressing roller toward the heating roller in response to a pressure signal from the thickness selector;

a fixing pressure adjuster to set a pressure at which the pressing roller presses against the heating roller, wherein the pressure is determined based upon the input received by the thickness selector; and a pair of curved hinge cams to move the pressing roller in either of two directions.

15. The image forming apparatus of claim 14 comprising a side cover, wherein:

the side cover is opened for service of the image forming apparatus, and the elastic members pull the pressing roller away from the heating roller.

16. The image forming apparatus of claim 14, wherein the thickness selector is set for two thicknesses of print medium.

17. The image forming apparatus of claim 16, wherein the thickness selector is set for standard paper printing and envelope printing.

* * * * *